US008873777B2

(12) United States Patent
Yoshino

(10) Patent No.: US 8,873,777 B2
(45) Date of Patent: Oct. 28, 2014

(54) VARIABLE DIRECTIVITY CONDENSER MICROPHONE

(71) Applicant: Kabushiki Kaisha Audio-Technica, Machida (JP)

(72) Inventor: Satoshi Yoshino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 0 days.

(21) Appl. No.: 14/057,587

(22) Filed: Oct. 18, 2013

(65) Prior Publication Data

US 2014/0112514 A1 Apr. 24, 2014

(30) Foreign Application Priority Data

Oct. 24, 2012 (JP) ..... 2012-234675

(51) Int. Cl.
*H04R 25/00* (2006.01)
*H04R 3/00* (2006.01)

(52) U.S. Cl.
CPC ..... *H04R 3/00* (2013.01)
USPC ..... 381/174; 381/113; 381/356

(58) Field of Classification Search
USPC ..... 381/111, 113, 116, 120, 122, 174, 356, 381/358, 313
See application file for complete search history.

(56) References Cited

U.S. PATENT DOCUMENTS 6,453,048 B1 * 9/2002 Akino ..... 381/113
7,295,675 B2 * 11/2007 Akino et al. ..... 381/113

FOREIGN PATENT DOCUMENTS

JP H07-143595 A 6/1995
JP 2012-065147 A 3/2012

* cited by examiner

*Primary Examiner* — Huyen D Le
(74) *Attorney, Agent, or Firm* — Manabu Kanesaka

(57) ABSTRACT

A first diaphragm FD and a second diaphragm RD are respectively arranged across a fixed electrode BP at both sides to constitute the variable directivity condenser microphone. A microphone body 1 includes a vacuum tube Q1 for impedance converting an audio signal obtained at the fixed electrode, and a connector 2 provided with a hot side connector terminal and a cold side connector terminal through which the audio signal that is impedance converted by the vacuum tube is outputted in parallel. A means for supplying a polarization voltage applied to the second diaphragm RD from an external power supply circuit 3 is arranged such that the hot side connector terminal and the cold side connector terminal are used as a forward conductor and a ground connector terminal for the microphone body arranged at the connector is used as a return conductor.

18 Claims, 2 Drawing Sheets

VARIABLE DIRECTIVITY CONDENSER MICROPHONE

BACKGROUND OF THE INVENTION

1. Field of the Invention

The present invention relates to a variable directivity condenser microphone having two condenser-type microphone units disposed on opposite sides of a fixed electrode, more particularly to a variable directivity condenser microphone using a vacuum tube as an impedance converter.

2. Description of the Related Art

As a microphone whose directivity is variable, one having two condenser-type microphone units disposed on opposite sides of a fixed electrode is known.

In this case, the above-mentioned two microphone units each have cardioid directivity. The variable directivity is realized by adjusting a polarization voltage applied to each unit or by controlling a degree of addition of an audio output signal from each unit. This is disclosed in Japanese Patent Application Publication No. H7-143595, Japanese Patent Application Publication No. 2012-65147, etc.

On the other hand, since the condenser-type microphone unit has a very high output impedance, FET (field-effect transistor) or a vacuum tube is used as an impedance converter. When using the latter vacuum tube as the impedance converter, it is usually necessary to prepare a dedicated power supply.

In other words, in operation, the above-mentioned vacuum tube needs one that is commonly referred to as an A-power supply for heating a heater of the vacuum tube and one that is commonly referred to as a B-power supply for supplying a high voltage to a plate of the vacuum tube.

In general, the vacuum tube used as the impedance converter needs a DC power supply which provides 6.3 V as the above-mentioned A-power supply and one that provides around 120 V as the above-mentioned B-power supply. Therefore, an external power supply dedicated to the vacuum tube is used, since a phantom (Phantom) power supply which provides DC 48 V and is often employed when using the above-mentioned FET as the impedance converter cannot supply sufficient electric power to drive the above-mentioned vacuum tube.

FIG. 2 shows an example of a conventional circuit block diagram, in which the vacuum tube is used as the impedance converter, and it is arranged that drive power is supplied from an external power supply circuit to the above-mentioned vacuum tube etc.

In FIG. 2, the external power supply circuit 3 surrounded by broken lines is connected to a microphone body 1 through a connector indicated by reference sign 2. Further, terminals (1), (2), and (3) of the connector 2 are connected with a mixer amplifier (not shown) etc., via a balanced shielded cable, through which an audio signal is outputted.

That is to say, the terminal (1) of the connector 2 is a ground (GND) connector terminal of the microphone body 1. The terminal (2) is a hot (HOT) side connector terminal for the audio signal, and the terminal (3) is a cold (COLD) side connector terminal for the audio signal.

Further, reference sign MC indicates a condenser-type microphone unit in which, on opposite sides of a fixed electrode BP, a front diaphragm FD (also referred to as first diaphragm) and a rear diaphragm RD (also referred to as second diaphragm) are arranged in front of it and behind it respectively. That is to say, a first microphone unit is constituted by the fixed electrode BP and the front diaphragm FD and a second microphone unit is constituted by the fixed electrode BP and the rear diaphragm RD. Furthermore, each of the above-mentioned first and the second microphone units has the cardioid directivity.

The above-mentioned central fixed electrode BP is connected to a point of reference potential of the microphone body 1, i.e., a ground (GND) connector terminal (terminal (1)) of the connector 2 through a resistance element R1. Further, a constant polarization voltage (for example, DC 120 V) is applied to the front diaphragm FD (which constitutes the first microphone unit) from an external power supply circuit 3 through a terminal (5) of the connector 2. Furthermore, it is arranged that the rear diaphragm RD which constitutes the second microphone unit is supplied with a positive or negative variable DC voltage from an external power supply circuit 3 through a terminal (6) of the connector 2.

The above-mentioned external power supply circuit 3 is provided with direct-current power supplies E1 and E2 (positive or negative) whose ends are connected to the above-mentioned point of reference potential respectively. Two ends of a potentiometer VR are respectively connected to a positive terminal of the DC power supply E1 and a negative terminal of the DC power supply E2. Further, a slide terminal of the potentiometer VR is connected to the above-mentioned terminal (6) of the connector 2.

Both the above-mentioned direct-current power supplies E1 and E2 (positive or negative) are set as 120 V, so that a polarization voltage which is varied from +120 V to −120 V by operation of the slide terminal of the potentiometer VR can be applied to the rear diaphragm RD which constitutes the second microphone unit.

On the other hand, the fixed electrode BP which constitutes the above-mentioned microphone unit MC is connected to a grid of a vacuum tube (triode) Q1. Further, a voltage of 120 V which is supplied to the above-mentioned front diaphragm FD as a polarization voltage is applied to a plate of the vacuum tube Q1 through a plate resistor R2.

Furthermore, a cathode resistor R3 and a capacitor element C1 are connected in parallel between a cathode of the above-mentioned vacuum tube Q1 and the point of the reference potential so as to constitute a cathode bias circuit, thereby applying a negative bias to the grid of the vacuum tube Q1 through the above-mentioned resistance element R1.

One end of a primary winding of a transformer T1 is connected to the plate of the above-mentioned vacuum tube Q1 through a coupling capacitor C2. The other end of the primary winding is connected to the point of reference potential. Further, ends of a secondary winding of the above-mentioned transformer T1 are respectively connected to the terminals (2) and (3) of the connector 2. An audio signal is outputted in parallel from the microphone body 1 to the above-mentioned mixer amplifier etc. through the above-mentioned terminals (2) and (3).

It should be noted that the A-power supply (6.3 V) is arranged to be supplied to a heater H1 of the vacuum tube Q1 from the external power supply circuit 3 through the terminal (4) of the connector 2, as shown in FIG. 2.

In the arrangement shown in FIG. 2, as described above, a polarization voltage of 120 V is always applied to the front diaphragm FD which constitutes the first microphone unit. Further, by adjusting the potentiometer VR provided for the external power supply circuit 3, an arbitrary polarization voltage within a range of from +120 V to −120 V can be applied to the rear diaphragm RD which constitutes the second microphone unit.

Therefore, in the case where, for example, +120 V is applied to the rear diaphragm RD (which constitutes the second microphone unit) by adjusting the potentiometer VR provided for the external power supply circuit 3, it is possible to obtain a directivity in which an output from the second microphone unit is added in phase to an output from the first microphone unit, i.e., a non-directional property.

Further, a polarization voltage of 0 V applied to the rear diaphragm RD which constitutes the second microphone unit does not generate an output from the second microphone unit, whereby, an output only from the first microphone unit, i.e., a cardioid directivity, can be obtained.

Furthermore, in the case where the polarization voltage applied to the rear diaphragm RD which constitutes the second microphone unit is −120 V, it is possible to obtain a directivity in which the output of the second microphone unit is subtracted from the output of the first microphone unit, i.e., a bidirectional property.

Incidentally, according to the variable directivity condenser microphone shown in FIG. 2, the external power supply circuit 3 provides the above-mentioned vacuum tube Q1 with A-power (supply) and B-power (supply) through the connector 2 of the microphone body 1, and the polarization voltage is also supplied to each of the diaphragms FD and RD of the microphone unit MC. In addition, in the circuit arrangement shown in FIG. 2, it is arranged that the above-mentioned B-power (supply) applied to the plate of the vacuum tube Q1 is also applied to the front diaphragm FD using as the polarization voltage. However, it is necessary for the polarization voltage applied to the rear diaphragm RD to be supplied through one of the terminals provided for the above-mentioned connector 2, i.e. the terminal (6) in FIG. 2.

As such, according to this type of condenser microphone which uses the vacuum tube as an impedance conversion means, there are a lot of connection wirings between the connector 2 provided on the microphone body 1 side and the external power supply circuit 3, so that an increase in the number of terminals provided for the above-mentioned connector and an increase in the number of connection wirings connected with the external power supply circuit side may reduce reliability of operation.

Therefore, it is a technically important subject to attain a decrease in the number of terminals used in the above-mentioned connector and simplification of the connection wirings between the connector and the external power supply circuit side. The present invention mainly aims to solve the above-mentioned problems.

SUMMARY OF THE INVENTION

The variable directivity condenser microphone in accordance with the present invention made in order to solve the above-mentioned problems is a variable directivity condenser microphone in which a first diaphragm and a second diaphragm are arranged on opposite sides of a fixed electrode to provide two microphone units and directivity is varied by varying a polarization voltage applied to one of the above-mentioned microphone units with respect to a polarization voltage applied to the other microphone unit, wherein a microphone body is provided with a vacuum tube for impedance converting an audio signal obtained at the above-mentioned fixed electrode and a connector having a hot side connector terminal and a cold side connector terminal through which an audio signal that is impedance converted by the above-mentioned vacuum tube is outputted in parallel, a means for supplying a polarization voltage applied to one of the above-mentioned microphone unit from an external power supply circuit is arranged by using the above-mentioned hot side connector terminal and cold side connector terminal as a forward conductor, and a ground connector terminal of the microphone body arranged at the above-mentioned connector is used as a return conductor.

In this case, it is desirable that the above-mentioned hot side connector terminal and cold side connector terminal used as the forward conductor which serve as the means for supplying the above-mentioned polarization voltage are supplied with equally divided currents.

Further, in one preferred embodiment, the polarization voltage supplied across the above-mentioned first diaphragm and the fixed electrode is set as a constant voltage, the polarization voltage supplied across the above-mentioned second diaphragm and the fixed electrode is set as a variable voltage, and the polarization voltage of the variable voltage supplied across the above-mentioned second diaphragm and the fixed electrode is supplied by means of the above-mentioned hot side connector terminal, the cold side connector terminal, and the ground connector terminal.

In addition, it is preferable that the polarization voltage of the constant voltage supplied across the above-mentioned first diaphragm and the fixed electrode is arranged to be used as a plate voltage for the above-mentioned vacuum tube.

Further, an arrangement is suitably employed where the audio signal which is impedance converted by the above-mentioned vacuum tube is outputted in parallel through a transformer to the above-mentioned hot side connector terminal and cold side connector terminal.

In this case, it is desirable that the polarization voltage applied to the above-mentioned microphone unit from the above-mentioned external power supply circuit is supplied through a center tap formed in the secondary winding of the above-mentioned transformer. Further, it is desirable that a resistance element is inserted between the center tap formed in the secondary winding of the above-mentioned transformer and the above-mentioned microphone unit.

According to the above-mentioned variable directivity condenser microphone in accordance with the present invention, since it is arranged that the audio signal which is impedance converted by the vacuum tube so as to be outputted in parallel using the hot side connector terminal and the cold side connector terminal, and that the above-mentioned hot side connector terminal and the cold side connector terminal are used as the forward conductor of the polarization voltage which is supplied from the external power supply circuit and applied to one microphone unit, it is possible to simplify the connection arrangement of the microphone body and the external power supply circuit.

In addition, since it is arranged that the other polarization voltage supplied from the external power supply circuit is shared by the plate voltage supplied to the above-mentioned vacuum tube, it is possible to contribute to simplifying the connection arrangement of the microphone body and the external power supply circuit.

DESCRIPTION OF THE PREFERRED EMBODIMENTS

Hereinafter, a variable directivity condenser microphone in accordance with the present invention will be described with reference to a preferred embodiment shown in FIG. 1.

In addition, in FIG. 1 below, parts which function similarly to those illustrated in FIG. 2 above are denoted by the same reference signs. Accordingly, the description of these parts will not be repeated.

Figure 1:
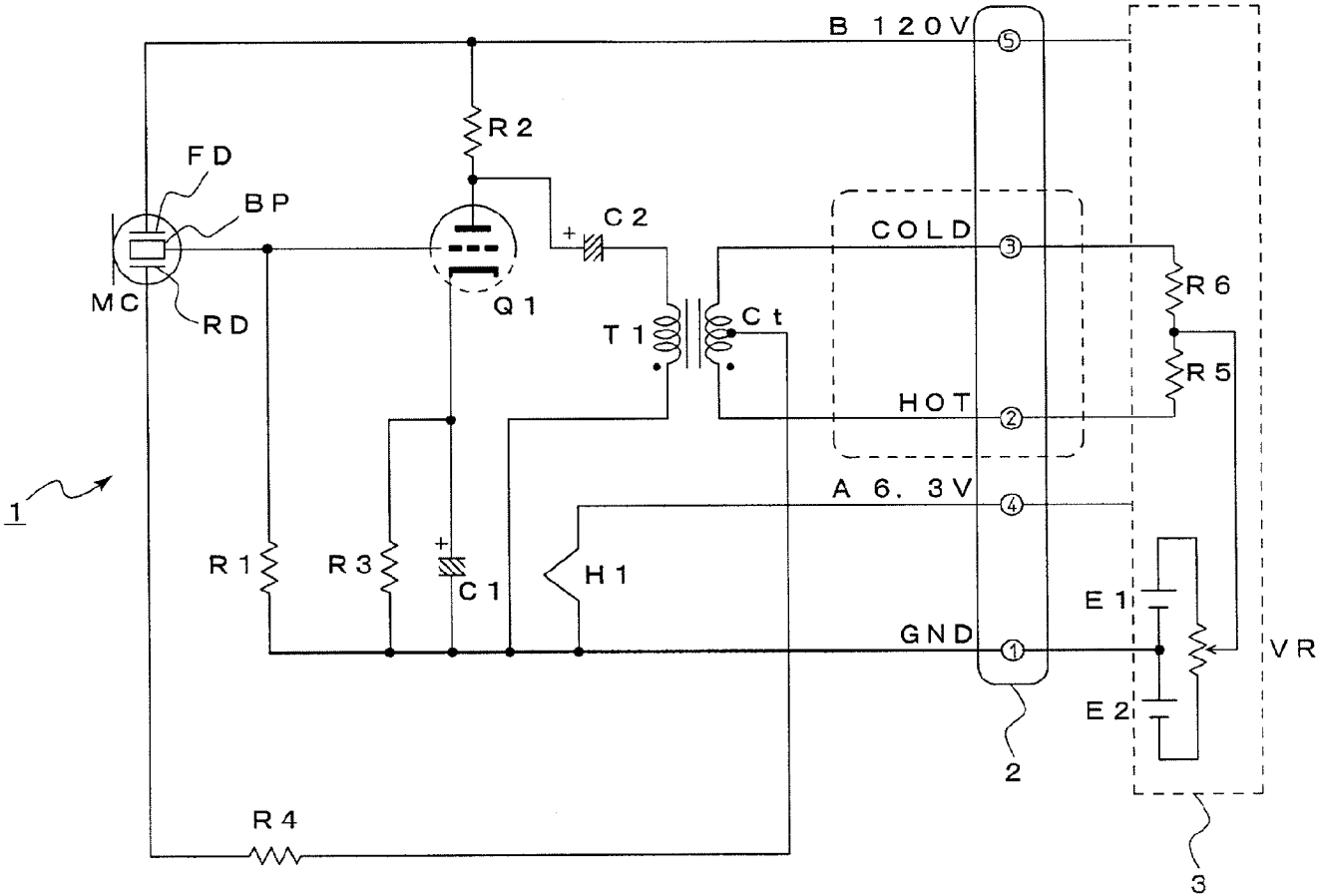
FIG. 1 is a circuit block diagram of a variable directivity condenser microphone in accordance with the present invention.
Figure 2:
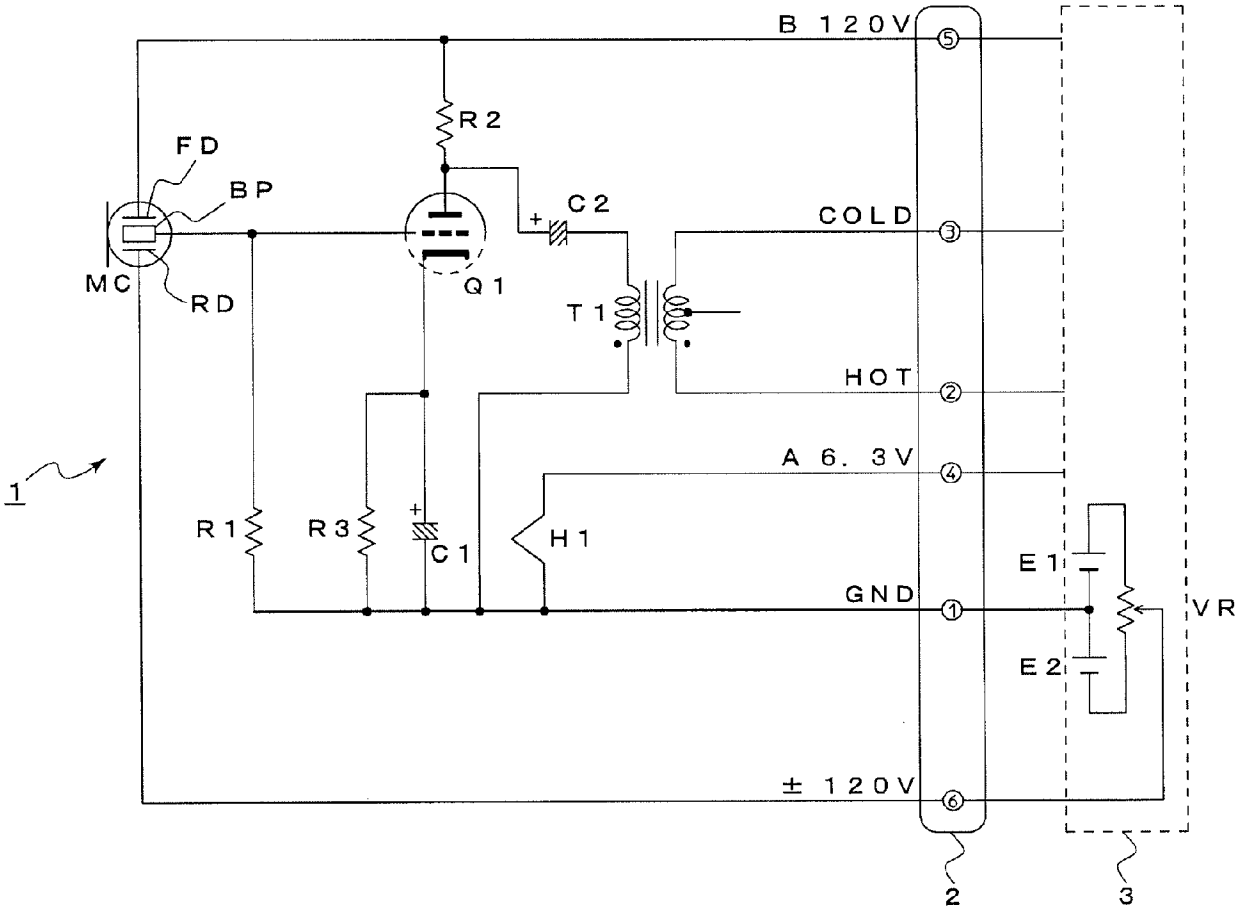
Fig. 2 Prior Art
FIG. 2 is a circuit block diagram showing an example of a conventional variable-directivity condenser microphone.

As shown in FIG. 1, also in the variable directivity condenser microphone in accordance with the present invention, an arrangement is employed where an external power supply circuit 3 surrounded by broken lines is connected through the connector denoted by reference sign 2 and provided for a microphone body 1. Further, terminals (1), (2), and (3) in a connector 2 are connected to a mixer amplifier (not shown) etc., via a balanced shielded cable, through which an audio signal is outputted.

That is to say, the terminal (1) of the connector 2 is a ground (GND) connector terminal of the microphone body 1. The terminal (2) is a hot (HOT) side connector terminal for an audio signal, and the terminal (3) is a cold (COLD) side connector terminal for the audio signal.

Further, also in a condenser-type microphone unit MC, on opposite sides of a fixed electrode BP, a front diaphragm FD (first diaphragm) and a rear diaphragm RD (second diaphragm) are arranged in front of and behind it respectively. That is to say, a first microphone unit is constituted by the fixed electrode BP and the front diaphragm FD and a second microphone unit is constituted by the fixed electrode BP and the rear diaphragm RD. Furthermore, each of the above-mentioned first and the second microphone units has the cardioid directivity.

The central fixed electrode BP in the above-mentioned microphone unit MC is connected to a point of reference potential of the microphone body 1, i.e., a ground (GND) connector terminal of the connector 2 through a resistance element R1. Further, a constant polarization voltage (for example, DC 120 V) is applied to the front diaphragm FD (which constitutes the first microphone unit) from the external power supply circuit 3 through a terminal (5) of the connector 2. A voltage of DC 120 V is applied to a plate of the vacuum tube Q1 via the resistance element R2.

Furthermore, it is arranged that the polarization voltage is applied to the rear diaphragm RD (which constitutes the second microphone unit) from a center tap Ct formed in the secondary winding of a transformer T1 through a resistance element R4 having a resistivity of around a few tens of MΩ.

The polarization voltage applied to the rear diaphragm RD of this second microphone unit is generated in the external power supply circuit 3 as described above.

That is to say, the external power supply circuit 3 is provided with DC power supplies E1 and E2 (positive or negative), one end of which is connected to the point of reference potential (terminal (1) of the connector 2), and two ends of the potentiometer VR are respectively connected to a positive terminal of one DC power supply E1 and a negative terminal of the other DC power supply E2.

Further, a slide terminal of the above-mentioned potentiometer VR is arranged such that the terminals (2) and (3) of the above-mentioned connector 2 may be supplied with DC voltages respectively through resistance elements R5 and R6 which have substantially the same resistivity.

Both the above-mentioned direct-current power supplies E1 and E2 (positive or negative) are set as 120 V, so that the DC voltage varied within a range of from +120 V to −120 V is supplied to the terminals (2) and (3) of the connector 2 by operation of the slide terminal of the potentiometer VR.

This variable DC voltage as the polarization voltage is supplied to the rear diaphragm RD (which constitutes the above-mentioned second microphone unit) through the center tap Ct formed in the secondary winding of the above-mentioned transformer T1.

Therefore, by adjusting the potentiometer VR provided for the above-mentioned external power supply circuit 3, the directivity of the microphone body 1 can be selected from the properties, such as non-directional property, a wide cardioid property, a cardioid property, a hyper-cardioid property, and bidirectional property, as already described.

As already described with reference to FIG. 2, the above-mentioned transformer T1 is such that one end of the primary winding is connected to the plate of the above-mentioned vacuum tube Q1 through the coupling capacitor C2, and the other end of the primary winding is connected to the point of reference potential.

Therefore, like the arrangement as already shown in and described with reference to FIG. 2, the audio signal generated at the fixed electrode BP of the above-mentioned microphone unit MC is impedance converted by the vacuum tube Q1, supplied to each of the above-mentioned terminals (2) and (3) of the connector 2 via the secondary winding of the above-mentioned transformer T1, and outputted in parallel as an audio signal.

It should be noted that the resistance element R4 having a comparatively high resistance inserted between the center tap Ct in the secondary winding of the above-mentioned transformer T1 and the rear diaphragm RD which constitutes the second microphone unit acts so as to prevent AC troubles from being caused on a signal line connected between the rear diaphragm RD and the secondary winding of the transformer T1.

That is to say, for example, if AC components, such as external noises, take place at both ends of the transformer T1 (at the hot side terminal and the cold side terminal), then basically the AC components at both the ends of the transformer T1 are mutually cancelled and only a DC component is outputted to the center tap Ct.

However, the AC components may not be cancelled (perfectly) mutually and may appear at the center tap Ct. Then, in order to prevent the thus appeared AC component from being mixed with the polarization voltage for the microphone unit MC, the high resistance element R4 as a high impedance load is inserted to allow only a small amount of DC current to flow, without allowing the above-mentioned AC component to flow.

In the preferred embodiment as shown in FIG. 1, respective ends of the secondary winding of the transformer T1 are used as parallel output terminals of the audio signal, i.e., the hot side connector terminal (terminal (2)) and the cold side connector terminal (terminal (3)); the hot side connector terminal and the cold side connector terminal are used as a means for applying the polarization voltage to the rear diaphragm RD which constitutes the above-mentioned second microphone unit.

That is to say, the polarization voltage provided from the potentiometer VR in the external power supply circuit 3 is supplied to the above-mentioned terminals (2) and (3) of the connector 2 respectively through the resistance elements R5 and R6 having substantially the same resistivity, and then applied to the rear diaphragm RD of the second microphone unit from the center tap Ct of the secondary winding of the above-mentioned transformer.

Therefore, a polarization voltage supply path directed towards the second microphone unit is such that the forward conductor is arranged by equally dividing the supply current to flow into the above-mentioned hot side connector terminal (terminal (2)) and the cold side connector terminal (terminal (3)), and the ground connector terminal (terminal (1)) of the microphone body 1 arranged at the above-mentioned connector 2 is used as the return conductor.

As such, a so-called phantom power supply is used as the means for supplying the polarization voltage for the condenser microphone. In this type of variable directivity condenser microphone in which the vacuum tube is used as the impedance converter, it is possible to effectively contribute to reduction in the number of connection wirings between the microphone body 1 and the external power supply circuit 3.

In addition, in the above-mentioned preferred embodiment, it is arranged that the other polarization voltage supplied from the external power supply circuit 3 is also used for the plate voltage applied to the vacuum tube. By employing this arrangement, it is possible to contribute to further reduction in the number of connection wirings between the microphone body and the external power supply circuit. Thus, the operational effects as described above (in "Effects of the Invention) can be obtained.

What is claimed is:

1. A variable directivity condenser microphone in which a first diaphragm and a second diaphragm are arranged on opposite sides of a fixed electrode to provide two microphone units and directivity is varied by varying a polarization voltage applied to one of said microphone units with respect to a polarization voltage applied to the other microphone unit, wherein a microphone body is provided with a vacuum tube for impedance converting an audio signal obtained at said fixed electrode and a connector having a hot side connector terminal and a cold side connector terminal through which an audio signal that is impedance converted by said vacuum tube is outputted in parallel, a means for supplying a polarization voltage applied to one of said microphone from an external power supply circuit is arranged by using said hot side connector terminal and cold side connector terminal as a forward conductor, and a ground connector terminal of the microphone body arranged at said connector is used as a return conductor.

2. A variable directivity condenser microphone as claimed in claim 1, wherein it is arranged that said hot side connector terminal and cold side connector terminal used as the forward conductor which serve as the means for supplying said polarization voltage are supplied with equally divided currents.

3. A variable directivity condenser microphone as claimed in claim 2, wherein the polarization voltage supplied across said first diaphragm and the fixed electrode is set as a constant voltage, the polarization voltage supplied across said second diaphragm and the fixed electrode is set as a variable voltage, and the polarization voltage of the variable voltage supplied across said second diaphragm and the fixed electrode is supplied by means of said hot side connector terminal, the cold side connector terminal, and the ground connector terminal.

4. A variable directivity condenser microphone as claimed in claim 3, wherein the audio signal which is impedance converted by said vacuum tube is outputted in parallel through a transformer to said hot side connector terminal and cold side connector terminal.

5. A variable directivity condenser microphone as claimed in claim 4, wherein the polarization voltage applied to said microphone unit from said external power supply circuit is supplied through a center tap formed in the secondary winding of said transformer.

6. A variable directivity condenser microphone as claimed in claim 5, wherein a resistance element is inserted between the center tap formed in the secondary winding of said transformer and said microphone unit.

7. A variable directivity condenser microphone as claimed in claim 3, wherein the polarization voltage of the constant voltage supplied across said first diaphragm and the fixed electrode is used as a plate voltage for said vacuum tube.

8. A variable directivity condenser microphone as claimed in claim 2, wherein the audio signal which is impedance converted by said vacuum tube is outputted in parallel through a transformer to said hot side connector terminal and cold side connector terminal.

9. A variable directivity condenser microphone as claimed in claim 8, wherein the polarization voltage applied to said microphone unit from said external power supply circuit is supplied through a center tap formed in the secondary winding of said transformer.

10. A variable directivity condenser microphone as claimed in claim 9, wherein a resistance element is inserted between the center tap formed in the secondary winding of said transformer and said microphone unit.

11. A variable directivity condenser microphone as claimed in claim 1, wherein the polarization voltage supplied across said first diaphragm and the fixed electrode is set as a constant voltage, the polarization voltage supplied across said second diaphragm and the fixed electrode is set as a variable voltage, and the polarization voltage of the variable voltage supplied across said second diaphragm and the fixed electrode is supplied by means of said hot side connector terminal, the cold side connector terminal, and the ground connector terminal.

12. A variable directivity condenser microphone as claimed in claim 11, wherein the audio signal which is impedance converted by said vacuum tube is outputted in parallel through a transformer to said hot side connector terminal and cold side connector terminal.

13. A variable directivity condenser microphone as claimed in claim 12, wherein the polarization voltage applied to said microphone unit from said external power supply circuit is supplied through a center tap formed in the secondary winding of said transformer.

14. A variable directivity condenser microphone as claimed in claim 13, wherein a resistance element is inserted between the center tap formed in the secondary winding of said transformer and said microphone unit.

15. A variable directivity condenser microphone as claimed in claim 11, wherein the polarization voltage of the constant voltage supplied across said first diaphragm and the fixed electrode is used as a plate voltage for said vacuum tube.

16. A variable directivity condenser microphone as claimed in claim 1, wherein the audio signal which is impedance converted by said vacuum tube is outputted in parallel through a transformer to said hot side connector terminal and cold side connector terminal.

17. A variable directivity condenser microphone as claimed in claim 16, wherein the polarization voltage applied to said microphone unit from said external power supply circuit is supplied through a center tap formed in the secondary winding of said transformer.

18. A variable directivity condenser microphone as claimed in claim 17, wherein a resistance element is inserted between the center tap formed in the secondary winding of said transformer and said microphone unit.

* * * * *